166-307 SR
PTU04 XR 3,948,755

United States Patent [19]
McCollum et al.

[11] 3,948,755
[45] Apr. 6, 1976

[54] PROCESS FOR RECOVERING AND UPGRADING HYDROCARBONS FROM OIL SHALE AND TAR SANDS

[75] Inventors: John D. McCollum, Munster, Ind.; Leonard M. Quick, Park Forest South, Ill.

[73] Assignee: Standard Oil Company, Chicago, Ill.

[22] Filed: May 31, 1974

[21] Appl. No.: 474,909

[52] U.S. Cl. ..... 208/11 LE
[51] Int. Cl.[2] ..... C10G 1/04
[58] Field of Search ..... 208/11, 113, 123, 124, 208/208 R, 251 R

[56] References Cited
UNITED STATES PATENTS

| | | | |
|---|---|---|---|
| 3,116,234 | 12/1963 | Douwes et al. | 208/208 R |
| 3,501,396 | 3/1970 | Gatsis | 208/216 |
| 3,586,621 | 6/1971 | Pitchford et al. | 208/226 |
| 3,676,331 | 7/1972 | Pitchford | 208/112 |
| 3,725,495 | 4/1973 | Wrisberg et al. | 208/124 |

*Primary Examiner*—Delbert E. Gantz
*Assistant Examiner*—James W. Hellwege
*Attorney, Agent, or Firm*—James R. Henes; Arthur G. Gilkes; William T. McClain

[57] ABSTRACT

A process for recovering and upgrading hydrocarbons from oil shale and tar sands by contacting the oil shale or tar sands with a dense-water-containing fluid at a temperature in the range of from about 600°F. to about 900°F. in the absence of externally supplied hydrogen and in the presence of a sulfur-resistant catalyst and wherein the density of the water in said fluid is at least 0.10 gram per milliliter.

20 Claims, 5 Drawing Figures

PROCESS FOR RECOVERING AND UPGRADING HYDROCARBONS FROM OIL SHALE AND TAR SANDS

BACKGROUND OF THE INVENTION

1. Field of the Invention

This invention involves a process for recovering, cracking, desulfurizing, and demetalating hydrocarbons from oil shale and tar sands.

2. Description of the Prior Art

The potential reserves of liquid hydrocarbons contained in subterranean carbonaceous deposits are known to be very substantial and form a large portion of the known energy reserves in the world. In fact, the potential reserves of liquid hydrocarbons to be derived from oil shale and tar sands greatly exceed the known reserves of liquid hydrocarbons to be derived from petroleum. As a result of the increasing demand for light hydrocarbon fractions, there is much current interest in economical methods for recovering liquid hydrocarbons from oil shale and tar sands on a commercial scale. Various methods of recovery of hydrocarbons from these deposits have been proposed, but the principal difficulty with these methods is their high cost which renders the recovered hydrocarbons too expensive to compete with petroleum crudes recovered by more conventional methods.

Moreover, the value of hydrocarbons recovered from oil shale and tar sands is diminished due to the presence of certain contaminants in the recovered hydrocarbons and the form of the recovered hydrocarbons. The chief contaminants are sulfurous, nitrogenous, and metallic compounds which cause detrimental effects with respect to various catalysts utilized in a multitude of processes to which the recovered hydrocarbons may be subjected. These contaminants are also undesirable because of their disagreeable odor, corrosive characteristics, and combustion products. Also the oil obtained from tar sands is heavier and more viscous than conventional petroleum crude and has properties resembling those of residual materials. About 50 percent of the hydrocarbon fraction recovered from tar sands boils above 1000° F. and can not be pumped in a conventional crude pipeline because of the relatively high pour point and viscosity.

Additionally, as a result of the increasing demand for light hydrocarbon fractions, there is much current interest in more efficient methods for converting the heavier hydrocarbon fractions recovered from oil shale and tar sands into lighter materials. The conventional methods of converting heavier hydrocarbon fractions into lighter materials, such as catalytic cracking, coking, thermal cracking and the like, always result in the production of more highly refractory materials.

It is known that such heavier hydrocarbon fractions and such refractory materials can be converted to lighter materials by hydrocracking. Hydrocracking processes are most commonly employed on liquefied coals or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes may be operated on a strictly thermal basis or in the presence of a catalyst.

However, the application of the hydrocracking technique has in the past been fairly limited because of several interrelated problems. Conversion by the hydrocracking technique of heavy hydrocarbon fractions recovered from oil shale and tar sands to more useful products is complicated by the presence of certain contaminants in such hydrocarbon fractions. Oils extracted from oil shale and tar sands contain nitrogenous, sulfurous, and organo-metallic compounds in exceedingly large quantities. The presence of sulfur- and nitrogen-containing and organo-metallic compounds in crude oils and various refined petroleum products and hydrocarbon fractions has long been considered undesirable.

For example, because of the disagreeable odor, corrosive characteristics and combustion products (particularly sulfur dioxide) of sulfur-containing compounds, sulfur removal has been of constant concern to the petroleum refiner. Further, the heavier hydrocarbons are largely subjected to hydrocarbon conversion processes in which the conversion catalysts are, as a rule, highly susceptible to poisoning by sulfur compounds. This has led in the past to the selection of low-sulfur hydrocarbon fractions whenever possible. With the necessity of utilizing heavy, high sulfur hydrocarbon fractions in the future, economical desulfurization processes are essential. This need is further emphasized by recent and proposed legislation which seeks to limit sulfur contents of industrial, domestic, and motor fuels.

Generally, sulfur appears in feedstocks in one of the following forms: mercaptans, hydrogen sulfides, sulfides, disulfides, and as part of complex ring compounds. The mercaptans and hydrogen sulfides are more reactive and are generally found in the lower boiling fractions, for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms as sulfides, disulfides, and as part of complex ring compounds of which thiophene is a prototype. Such sulfur compounds are not susceptible to the conventional chemical treatments found satisfactory for the removal of mercaptans and hydrogen sulfide and are particularly difficult to remove from heavy hydrocarbon materials.

Nitrogen is undesirable because it effectively poisons various catalytic composites which may be employed in the conversion of heavy hydrocarbon fractions. In particular, nitrogen-containing compounds are effective in suppressing hydrocracking. Moreover, nitrogenous compounds are objectionable because combustion of fuels containing these impurities possibly contributes to the release of nitrogen oxides which are noxious and corrosive and present a serious problem with respect to pollution of the atmosphere. Consequently, removal of the nitrogenous contaminants is most important and makes practical and economically attractive the treatment of contaminated stocks.

However, in order to remove the sulfur or nitrogen or to convert the heavy residue into lighter more valuable products, the heavy hydrocarbon fraction is ordinarily subjected to a hydrocatalytic treatment. This is conventionally done by contacting the hydrocarbon fraction with hydrogen at an elevated temperature and pressure and in the presence of a catalyst. Unfortunately, unlike distillate stocks which are substantially free from asphaltenes and metals, the presence of asphaltenes and metal-containing compounds in heavy hydrocarbon fraction leads to a relatively rapid reduction in the activity of the catalyst to below a practical level. The presence of these materials in the charge stock results in the deposition of metal-containing coke on the catalyst particles, which prevents the charge from coming in contact with the catalyst and thereby, in effect, reduces the catalyst activity. Eventually, the on-stream period must be interrupted, and the catalyst must be regenerated or replaced with fresh catalyst.

Particularly objectionable is the presence of iron in the form of soluble organometallic compounds. Even when the concentration of iron porphyrin complexes and other iron organometallic complexes is relatively small, that is, on the order of parts per million, their presence causes serious difficulties in the refining and utilization of heavy hydrocarbon fractions. The presence of an appreciable quantity of the organometallic iron compounds in feedstocks undergoing catalytic cracking causes rapid deterioration of the cracking catalysts and changes the selectivity of the cracking catalysts in the direction of more of the charge stock being converted to coke. Also, the presence of an appreciable quantity of the organo-iron compounds in feedstocks undergoing hydroconversion (such as hydrotreating or hydrocracking) causes harmful effects in the hydroconversion processes, such as deactivation of the hydroconversion catalyst and, in many instances, plugging or increasing of the pressure drop in fixed bed hydroconversion reactors due to the deposition of iron compounds in the interstices between catalyst particles in the fixed bed of catalyst.

Additionally, metallic contaminants such as nickel- and vanadium-containing compounds are found as innate contaminants in hydrocarbon fractions recovered from oil shale and tar sands. When the hydrocarbon fractions are topped to remove the light fractions boiling above about 450°–650° F., the metals are concentrated in the residual bottoms. If the residuum is then further treated, such metals adversely affect catalysts. When the hydrocarbon fraction is used as a fuel, the metals also cause poor performance in industrial furnaces by corroding the metal surfaces of the furnace.

A promising technique for recovering liquid hydrocarbon from tar sands and from oil shale is a process called dense fluid extraction. Separation by dense fluid extraction at elevated temperatures is a relatively unexplored area. The basic principles of dense fluid extraction at elevated temperatures are outlined in the monograph "The Principles of Gas Extraction" by P. F. M. Paul and W. S. Wise, published by Mills and Boon Limited in London, 1971, of which Chapters 1 through 4 are specifically incorporated herein by reference. The dense fluid can be either a liquid or a dense gas having a liquid-like density.

Dense fluid extraction depends on the changes in the properties of a fluid — in particular, the density of the fluid — due to changes in the pressure. At temperatures below its critical temperature, the density of a fluid varies in step functional fashion with changes in the pressure. Such sharp transitions in the density are associated with vapor-liquid transitions. At temperatures above the critical temperature of a fluid, the density of the fluid increases almost linearly with pressure as required by the Ideal Gas Law, although deviations from linearity are noticeable at higher pressures. Such deviations are more marked as the temperature of the fluid is nearer, but still above, its critical temperature.

If a fluid is maintained at a temperature below its critical temperature and at its saturated vapor pressure, two phases will be in equilibrium with each other, liquid X of density C and vapor Y of density D. The liquid of density C will possess a certain solvent power. If the same fluid were then maintained at a particular temperature above its critical temperature and if it were compressed to density C, then the compressed fluid could be expected to possess a solvent power similar to that of liquid X of density C. A similar solvent power could be achieved at an even higher temperature by an even greater compression of the fluid to density C. However, because of the non-ideal behavior of the fluid near its critical temperature, a particular increase in pressure will be more effective in increasing the density of the fluid when the temperature is slightly above the critical temperature than when the temperature is much above the critical temperature of the fluid.

These simple considerations lead to the suggestion that at a given pressure and at a temperature above the critical temperature of a compressed fluid, the solvent power of the compressed fluid should be greater the lower the temperature; and that, at a given temperature above the critical temperature of the compressed fluid, the solvent power of the compressed fluid should be greater the higher the pressure.

Although such useful solvent effects have been found above the critical temperature of the fluid solvent, it is not essential that the solvent phase be maintained above its critical temperature. It is only essential that the fluid solvent be maintained at high enough pressures so that its density is high. Thus, liquid fluids and gaseous fluids which are maintained at high pressures and have liquid-like densities are useful solvents in dense fluid extractions at elevated temperatures.

The basis of separations by dense fluid extraction at elevated temperatures is that a substrate is brought into contact with a dense, compressed fluid at an elevated temperature, material from the substrate is dissolved in the fluid phase, then the fluid phase containing this dissolved material is isolated, and finally the isolated fluid phase is decompressed to a point where the solvent power of the fluid is destroyed and where the dissolved material is separated as a solid or liquid.

Some general conclusions based on empirical correlations have been drawn regarding the conditions for achieving high solubility of substrates in dense, compressed fluids. For example, the solvent effect of a dense, compressed fluid depends on the physical properties of the fluid solvent and of substrate. This suggests that fluids of different chemical nature but similar physical properties would behave similarly as solvents. An example is the discovery that the solvent power of compressed ethylene and carbon dioxide is similar.

In addition, it has been concluded that a more efficient dense fluid extraction should be obtained with a solvent whose critical temperature is nearer the extraction temperature than with a solvent whose critical temperature is farther from the extraction temperature. Further since the solvent power of the dense, compressed fluid should be greater the lower the temperature but since the vapor pressure of the material to be extracted should be greater the higher the temperature, the choice of extraction temperature should be a compromise between these opposing effects.

Various ways of making practical use of dense fluid extraction are possible following the analogy of conventional separation processes. For example, both the extraction stage and the decompression stage afford considerable scope for making separations of mixtures of materials. Mild conditions can be used to extract first the more volatile materials, and then more severe conditions can be used to extract the less volatile materials. The decompression stage can also be carried out in a single stage or in several stages so that the less volatile dissolved species separate first. The extent of extraction and the recovery of product on decompression can be controlled by selecting of an appropriate fluid solvent, by adjusting the temperature and pressure of the extraction or decompression, and by altering the ratio of substrate-to-fluid solvent which is charged to the extraction vessel.

In general, dense fluid extraction at elevated temperatures can be considered as an alternative, on the one hand, to distillation and, on the other hand, to extraction with liquid solvents at lower temperatures. A considerable advantage of dense fluid extraction over distillation is that it enables substrates of low volatility to be processed. Dense fluid extraction even offers an alternative to molecular distillation, but with such high concentrations in the dense fluid phase that a marked advantage in throughput should result. Dense fluid extraction would be of particular use where heat-liable substrates have to be processed since extraction into the dense fluid phase can be effected at temperatures well below those required by distllation.

A considerable advantage of dense fluid extraction at elevated temperatures over liquid extraction at lower temperatures is that the solvent power of the compressed fluid solvent can be continuously controlled by adjusting the pressure instead of the temperature. Having available a means of controlling solvent power by pressure changes gives a new approach and scope to solvent extraction processes.

Zhuze was apparently the first to apply dense fluid extraction to chemical engineering operations in a scheme for de-asphalting petroleum fractions using a propane-propylene mixture as gas, as reported in Vestnik Akad. Nauk S.S.S.R. 29 (11), 47–52 (1959); and in Petroleum (London) 23, 298–300 (1960).

Apart from Zhuze's work, there have been few detailed reports of attempts to apply dense fluid extraction techniques to substrates of commercial interest. British Pat. No. 1,057,911 (1964) describes the principles of gas extraction in general terms, emphasizes its use as a separation technique complementary to solvent extraction and distillation; and outlines multistage operation. British Pat. No. 1,111,422 (1965) refers to the use of gas extraction techniques for working up heavy petroleum fractions. A feature of particular interest is the separation of materials into residue and extract products, the latter being free from objectionable inorganic contaminants such as vanadium. The advantage is also mentioned in this patent of cooling the gas solvent at subcritical temperatures before recycling it. This converts it to the liquid form which requires less energy to pump it against the hydrostatic head in the reactor than would a gas. French Pat. Nos. 1,512,060 (1967) and 1,512,061 (1967) mention the use of gas extraction on petroleum fractions. In principle, these seem to follow the direction of the earlier Russian work.

In addition, there are other references to recovery of liquid hydrocarbon fractions from carbonaceous deposits by processes utilizing water. For example, Friedman et al., U.S. Pat. No. 3,051,644 (1962) discloses a process for the recovery of oil from oil shale which involves subjecting oil shale particles dispersed in steam to treatment with steam at a temperature in the range of from 700° F. to 900° F. and at a pressure in the range of from 1000 to 3000 pounds per square inch gauge. Oil from the oil shale is withdrawn in vapor form admixed with steam.

Truitt et al., U.S. Pat. No. 2,665,238 (1954) discloses a method of recovering oil from oil shale which involves treating the shale with water in a large amount approximating the weight of the shale, at a temperature in excess of 500° F. and under a pressure in excess of 1000 pounds per square inch. The amount of oil recovered increases generally as the temperature or pressure is further increased, but pressures as high as about 3000 pounds per square inch gauge and temperatures at least approximately as high as 700° F. are required to effect a substantially complete recovery of the oil.

There have been numerous references to processes for cracking, desulfurizing, denitrifying, demetalating, and generally upgrading hydrocarbon fractions by processes involving water. For example, Gatsis, U.S. Pat. No. 3,453,206 (1969) discloses a multi-stage process for hydrorefining heavy hydrocarbon fractions for the purpose of eliminating and/or reducing the concentration of sulfurous, nitrogenous, organometallic, and asphaltenic contaminants therefrom. The nitrogenous and sulfurous contaminants are converted to ammonia and hydrogen sulfide. The stages comprise pretreating the hydrocarbon fraction in the absence of a catalyst, with a mixture of water and externally supplied hydrogen at a temperature above the critical temperature of water and a pressure of at least 1000 pounds per square inch gauge and then reacting the liquid product from the pretreatment stage with externally supplied hydrogen at hydrorefining conditions and in the presence of a catalytic composite. The catalytic composite comprises a metallic component composited with a refractory inorganic oxide carrier material of either synthetic or natural origin, which carrier material has a medium-to-high surface area and a well-developed pore structure. The metallic component can be vanadium, niobium, tantalum, molybdenum, tungsten, chromium, iron, cobalt, nickel, platinum, palladium, iridium, osmium, rhodium, ruthenium, and mixtures thereof.

Gatsis, U.S. Pat. No. 3,501,396 (1970) discloses a process for desulfurizing and denitrifying oil which comprises mixing the oil with water at a temperature above the critical temperature of water up to about 800° F. and at a pressure in the range of from about 1000 to about 2500 pounds per square inch gauge and reacting the resulting mixture with externally supplied hydrogen in contact with a catalytic composite. The catalytic composite can be characterized as a dual function catalyst comprising a metallic component such as iridium, osmium, rhodium, ruthenium and mixtures thereof and an acidic carrier component having cracking activity. An essential feature of this method is the catalyst being acidic in nature. Ammonia and hydrogen sulfide are produced in the conversion of nitrogenous and sulfurous compounds, respectively.

Pritchford et al., U.S. Pat. No. 3,586,621 (1971) discloses a method for converting heavy hydrocarbon oils, residual hydrocarbon fractions, and solid carbonaceous materials to more useful gaseous and liquid products by contacting the material to be converted with a nickel spinel catalyst promoted with a barium salt of an organic acid in the presence of steam. A temperature in the range of from 600° F. to about 1000° F. and a pressure in the range of from 200 to 3000 pounds per square inch gauge are employed.

Pritchford, U.S. Pat. No. 3,676,331 (1972) discloses a method for upgrading hydrocarbons and thereby producing materials of low molecular weight and of reduced sulfur content and carbon residue by introducing water and a catalyst system containing at least two components into the hydrocarbon fraction. The water can be the natural water content of the hydrocarbon fraction or can be added to the hydrocarbon fraction from an external source. The water-to-hydrocarbon fraction volume ratio is preferably in the range from about 0.1 to about 5. At least the first of the components of the catalyst system promotes the generation of hydrogen by reaction of water in the water gas shift reaction and at least the second of the components of the catalyst system promotes reaction between the hydrogen generated and the constituents of the hydrocarbon fraction. Suitable materials for use as the first component of the catalyst system are the carboxylic acid salts of barium, calcium, strontium, and magnesium. Suitable materials for use as the second component of the catalyst system are the carboxylic acid salts of nickel, cobalt, and iron. The process is carried out at a reaction temperature in the range of from about 750° F. to about 850° F. and at a pressure of from about 300 to about 4000 pounds per square inch gauge in order to maintain a principal portion of the crude oil in the liquid state.

Wilson et al., U.S. Pat. No. 3,733,259 (1973) discloses a process for removing metals, asphaltenes, and sulfur from a heavy hydrocarbon oil. The process comprises dispersing the oil with water, maintaining this dispersion at a temperature between 750° F. and 850° F. and at a pressure between atmospheric and 100 pounds per square inch gauge, cooling the dispersion after at least one-half hour to form a stable water-asphaltene emuslion, separating the emulsion from the treated oil, adding hydrogen, and contacting the resulting treated oil with a hydrogenation catalyst at a temperature between 500° F. and 900° F. and at a pressure between about 300 and 3000 pounds per square inch gauge.

It has also been announced that the semi-governmental Japan Atomic Energy Research Institute, working with the Chisso Engineering Corporation, has developed what is called a "simple, low-cost, hot-water, oil desulfurization process" said to have "sufficient commercial applicability to compete with the hydrogenation process." The process itself consists of passing oil through a pressurized boiling water tank in which water is heated up to approximately 250° C., under a pressure of about 100 atmospheres. Sulfides in oil are then separated when the water temperature is reduced to less than 100° C.

Thus far, no one has disclosed the method of this invention for recovering and upgrading hydrocarbon fractions from oil shale and tar sands, which permits operation at lower than conventional temperatures, without an external source of hydrogen, and without preparation or pretreatment, such as, desalting or demetalation, prior to upgrading the recovered hydrocarbon fraction.

SUMMARY OF THE INVENTION

This invention is a process for recovering hydrocarbons from oil shale or tar sands solids and simultaneously for cracking, desulfurizing, and demetalating the recovered hydrocarbons, which comprises contacting the oil shale or tar sands solids with a water-containing fluid at a temperature in the range of from about 600° F. to about 900° F. in the absence of externally supplied hydrogen and in the presence of a sulfur-resistant catalyst selected from the group consisting of at least one basic metal carbonate, basic metal hydroxide, transition metal oxide, oxide-forming transition metal salt, and combinations thereof. The density of water in the water-containing fluid is at least 0.10 gram per milliliter, and sufficient water is present to serve as an effective solvent for the hydrocarbon fraction. Essentially all the sulfur removed from the hydrocarbon fraction is in the form of elemental sulfur.

The density of water in the water-containing fluid is preferably at least 0.15 gram per milliliter and most preferably at least 0.2 gram per milliliter. The temperature is preferably at least 705° F., the critical temperature of water. The oil shale and tar sands solids and water-containing fluid are contacted preferably for a period of time in the range of from about 1 minute to about 6 hours, more preferably in the range of from about 5 minutes to about 3 hours and most preferably in the range of from about 10 minutes to about 1 hour. The weight ratio of the oil shale or tar sands solids-to-water in the water containing fluid is preferably in the range of from about 3:2 to about 1:10 and more preferably in the range of from about 1:1 to about 1:3. The water-containing fluid is preferably substantially water and more preferably water. The oil shale solids have preferably a maximum particle size of one-half inch diameter, more preferably a maximum particle size of one-quarter inch diameter and most preferably a maximum particle size of 8 mesh.

The transition metal in the oxide and salt in the catalyst is selected preferably from the group consisting of a transition metal of Group IVB, VB, VIB, and VIIB of the Periodic Chart, more preferably from the group consisting of vanadium, chromium, manganese, titanium, molybdenum, zirconium, niobium, tantalum, rhenium, and tungsten, and most preferably from the group consiting of chromium, manganese, titanium, tantalum, and tungsten. The metal in the basic metal carbonate and hydroxide is selected preferably from the group consisting of alkali and alkaline earth metals and more preferably from the group consisting of sodium and potassium. The catalyst is present in a catalytically effective amount which is equivalent to a concentration level in the water in the water-containing fluid preferably in the range of from about 0.01 to about 3.0 weight percent and more preferably in the range of from about 0.10 to about 0.50 weight percent.

DETAILED DESCRIPTION

Figure 1:
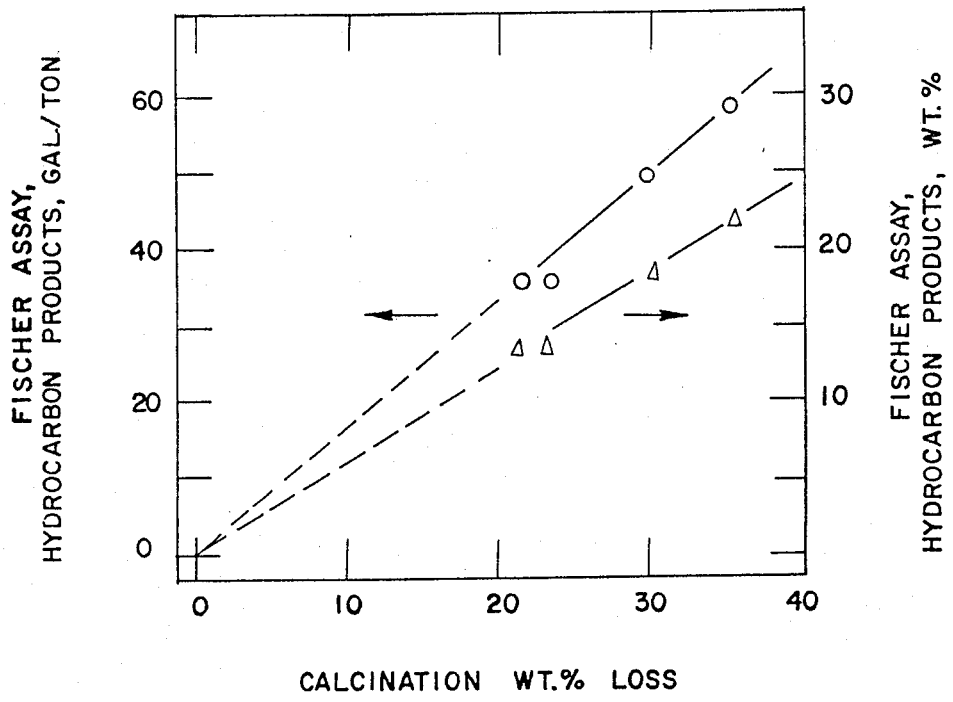
FIG. 1 is a graph showing the correlation of the calcination weight loss of oil shale solids with the results of the Fischer assay of such solids.

It has been found that hydrocarbons can be recovered from oil shale and tar sands solids and that the recovered hydrocarbons can be upgraded, cracked, desulfurized, and demetalated by contacting the oil shale or tar sands solids with a dense-water-containing phase, either gas or liquid, at a reaction temperature in the range of from about 600° F. to about 900° F. in the absence of externally supplied hydrogen, and in the presence of an externally supplied sulfur-resistant transition metal catalyst.

We have found that, in order to effect the recovery of hydrocarbons from oil shale and tar sands and in order to effect the chemical conversion of the recovered hydrocarbons into lighter, more useful hydrocarbon fractions by the method of this invention — which involves processes characteristically occurring in solution rather than typical pyrolytic processes — the water in the dense-water-containing fluid phase must have a high solvent power and liquid-like densities — for example, at least 0.1 gram per milliliter — rather than vapor-like densities. Maintenance of the water in the dense-water-containing phase at a relatively high density, whether at temperatures below or above the critical temperature of water, is essential to the method of this invention. The density of the water in the dense-water-containing phase must be at least 0.1 gram per milliliter.

The high solvent power of dense fluids is discussed in the monograph "The Principles of Gas Extraction" by P. F. M. Paul and W. S. Wise, published by Mills and Boon Limited in London, 1971. For example, the difference in the solvent power of steam and of dense gaseous water maintained at a temperature in the region of the critical temperature of water and at an elevated pressure is substantial. Even normally insoluble inorganic materials, such as silica and alumina, commence to dissolve appreciably in "supercritical water" — that is, water maintained at a temperature above the critical temperature of water — so long as a high water density is maintained.

Enough water must be employed so that there is sufficient water in the dense-water-containing phase to serve as an effective solvent for the recovered hydrocarbons. The water in the dense-water-containing phase can be in the form either of liquid water or of dense gaseous water. The vapor pressure of water in the dense-water-containing phase must be maintained at a sufficiently high level so that the density of water in the dense-water-containing phase is at least 0.1 gram per milliliter.

We have found that, with the limitations imposed by the size of the reaction vessels we employed in this work, a weight ratio of the oil shale or tar sands solids-to-water in the dense-water-containing phase in the range of from about 3:2 to about 1:10 is preferable and a ratio in the range of from about 1.1 to about 1:3 is more preferable.

A particularly useful water-containing fluid contains water in combination with an organic compound such as biphenyl, pyridine, a partly hydrogenated aromatic oil, or a mono- or polyhydric compound such as methyl alcohol. The use of such combinations extends the limits of solubility and rates of dissolution so that cracking, desulfurization, and demetalation can occur even more readily. Furthermore, the component other than water in the dense-water-containing phase can serve as a source of hydrogen, for example, by reaction with water.

The catalyst employed in the method of this invention is effective when added in an amount equivalent to a concentration in the water of the water-containing fluid in the range of from about 0.01 to about 3.0 weight percent and preferably in the range of from about 0.10 to about 0.50 weight percent.

The catalyst may be added as a solid and slurried in the reaction mixture or as a water-soluble salt, for example manganese chloride or potassium permanganate, which produces the corresponding oxide under the conditions employed in the method of this invention. Alternately, the catalyst can be deposited on a support and used as such in a fixed-bed flow configuration or slurried in the water-containing fluid.

This process can be performed either as a batch process or as a continuous or semi-continuous flow process. Contact times between the oil shale or tar sands solids and the dense water-containing phase — that is, residence time in a batch process or inverse solvent space velocity in a flow process — of from the order of minutes up to about 6 hours are satisfactory for effective cracking, desulfurization, and demetalation of the recovered hydrocarbons.

In the method of this invention, the water-containing fluid and the oil shale or tar sands solids are contacted by making a slurry of the oil shale or tar sands solids in the water-containing fluid.

When the method of this invention is performed above ground with mined oil shale or tar sands, the hydrocarbons can be recovered more rapidly if the mined solids are ground to a particle size preferably of ½-inch diameter or smaller. Alternately, the method of this invention could also be performed in situ in subterranean deposits by pumping the water-containing fluid into the deposit and withdrawing hydrocarbon products for separation or further processing.

EXAMPLES 1–37

Examples 1–37 involve batch processing of oil shale and tar sands feeds under a variety of conditions and illustrate that hydrocarbons are recovered, cracked, desulfurized, and demetalated in the method of this invention. Unless otherwise specified, the following procedure was used in each case. The oil shale or tar sands feed, water, and, if used, components of the catalyst system were loaded at ambient temperature into a 300-milliliter Hastelloy alloy C Magne-Drive batch autoclave in which the reaction mixture was to be mixed. The components of the catalyst system were added as solutes in the water or as solids in slurries in the water. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660°F. Approximately 6 minutes were required to raise the temperature from 660°F. to 700°F. Approximately another 6 minutes was required to raise the temperature from 700°F. to 750°F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized and was flash-distilled from the reaction vessel, removing the gas, water, and "oil", and leaving the "bitumen," inorganic residue, and catalyst, if present, in the reaction vessel. The "oil" was the liquid hydrocarbon fraction boiling at or below the reaction temperature and the "bitumen" was the hydrocarbon fraction boiling above the reaction temperature. The inorganic residue was spent shale or spent tar sands.

The gas, water, and oil were trapped in a pressure vessel cooled by liquid nitrogen. The gas was removed by warming the pressure vessel to room temperature and then was analyzed by mass spectroscopy, gas chromatography, and infra-red. The water and oil were then purged from the pressure vessel by means of compressed gas and occasionally also by heating the vessel. Then the water and oil were separated by decantation. The oil was analyzed for its sulfur and nitrogen content using x-ray fluorescence and the Kjeldahl method, respectively, and for its density and API gravity.

The bitumen, inorganic residue, and catalyst, if present, were washed from the reaction vessel with chloroform, and the bitumen dissolved in this solvent. The solid residue was then separated from the solution containing the bitumen by filtration. The bitumen was analyzed for its sulfur and nitrogen contents using the same methods as in the analysis of the oil. The solid residue was analyzed for its inorganic carbonate content.

In regard to the recovery of hydrocarbons from oil shale, several samples of oil shale were obtained from oil shale deposits in Colorado. These samples were obtained in the form of lumps, which were then ground and sieved to obtain fractions of various particle sizes. In order to estimate the kerogenic content of these fractions, portions of each sample were calcined in air at 1000° F. for 30 minutes to remove water and kerogenic carbonaceous matter without decomposing inorganic carbonate. The particle size of the samples of oil shale used in this work and the percent of weight loss during calcination for each of these samples are presented in Table 1.

Examples 1–36 involve batch recovery of hydrocarbons from the oil shale samples shown in Table 1 using the method described above. These runs were performed in a 300-milliliter Hastelloy alloy C Magne-Drive autoclave. The experimental conditions and the results determined in these Examples are presented in Tables 2 and 3, respectively.

In these Examples, the liquid hydrocarbon products were classified either as oils or as bitumens depending on whether or not such liquid products could be flashed from the autoclave upon depressurization of the autoclave at the run temperature employed. Oils were those liquid products which flashed over at the run temperature, while bitumens were those liquid products which remained in the autoclave. The oil fractions had densities in the range of from about 0.92 to about 0.94 grams per milliliter and had API gravities in the range of between about 19°API. to about 23°API. The bitumen fractions had densities of about 1.01 grams per milliliter and API gravities of about 10. Oil shale sample A contained 0.7 weight percent of sulfur, 1.7 weight percent of nitrogen.

Use of a catalyst in Example 36 caused a substantial increase in the amount of the oil fraction produced relative to the amount of the bitumen fraction produced.

The results of elemental analyses of several samples of oil and bitumen fractions obtained in several of these Examples and also oil shale feed, and oil kerogen product obtained using thermal retorting as reported by M. T. Atwood in Chemtech, October, 1973, pages 617–621, which is incorporated herein by reference, are shown in Table 4.

TABLE 1

| Oil Shale Sample | Particle Size[1] | Percent Weight Loss during Calcination |
|---|---|---|
| A | 60–80 | 32.2 |
| B | 14–28 | 26.8 |
| C | 8–14 | 36.6 |
| D | ¼–⅛[2] | 22.3 |

[1]mesh size, except where otherwise indicated.
[2]diameter measured in inches.

TABLE 2

| Example | Shale Sample[1] | Reaction Temperature (°F.) | Reaction Time[3] | Reaction Pressure[2] | Argon Pressure[2] | Amount of Water Added[4] | Shale-to-Water weight Ratio |
|---|---|---|---|---|---|---|---|
| 1 | A | 752 | 2 | 4200 | 400 | 60 | 1.0 |
| 2 | A | 660 | 2 | 2550 | 400 | 60 | 1.0 |
| 3 | A | 752 | 2 | 4550 | 300 | 90 | 0.56 |
| 4 | A | 715 | 2 | 3450 | 300 | 90 | 0.56 |
| 5 | A | 752 | 2 | 4300 | 300 | 90 | 0.56 |
| 6[5] | A | 752 | 2 | 4600 | 300 | 90 | 0.56 |
| 7 | A | 752 | 2 | 4100 | 400 | 90 | 0.56 |
| 8 | A | 752 | 2 | 4100 | 400 | 90 | 0.56 |
| 9 | A | 752 | 2 | 4100 | 400 | 90 | 0.56 |
| 10 | A | 752 | 2 | 4100 | 400 | 90 | 0.56 |
| 11 | A | 752 | 2 | 4100 | 400 | 90 | 0.56 |
| 12 | C | 752 | 2 | 4100 | 400 | 60 | 1.0 |
| 13 | B | 752 | 2 | 4200 | 400 | 60 | 1.0 |
| 14 | C | 752 | 2 | 4200 | 400 | 90 | 0.56 |
| 15 | B | 752 | 2 | 4200 | 400 | 90 | 0.56 |
| 16 | C | 752 | 1 | 4100 | 250 | 90 | 0.56 |
| 17 | C | 752 | 1 | 4200 | 250 | 90 | 0.56 |
| 18 | B | 752 | 1 | 4200 | 250 | 90 | 0.56 |

TABLE 2-continued

| Example | Shale Sample[1] | Reaction Temperature (°F.) | Reaction Time[3] | Reaction Pressure[2] | Argon Pressure[2] | Amount of Water Added[4] | Shale-to-Water weight Ratio |
|---|---|---|---|---|---|---|---|
| 19 | C | 752 | 0.5 | 4200 | 250 | 90 | 0.56 |
| 20 | B | 752 | 0.5 | 4200 | 250 | 90 | 0.56 |
| 21 | A | 752 | 1 | 4100 | 250 | 90 | 0.56 |
| 22 | A | 752 | 0.5 | 4100 | 250 | 90 | 0.56 |
| 23 | C | 716 | 2 | 3500 | 250 | 90 | 0.56 |
| 24 | B | 716 | 2 | 3500 | 250 | 90 | 0.56 |
| 25 | D | 752 | 2 | 4250 | 250 | 90 | 0.56 |
| 26 | D | 752 | 0.5 | 4150 | 250 | 90 | 0.56 |
| 27 | D | 698 | 0.5 | 3150 | 250 | 90 | 0.56 |
| 28 | B | 716 | 2 | 3500 | 250 | 90 | 0.56 |
| 29 | C | 752 | 13[6] | 3900 | 250 | 60 | 1 |
| 30 | C | 752 | 8[6] | 3700 | 250 | 60 | 1 |
| 31 | C | 752 | 3[6] | 3700 | 250 | 60 | 1 |
| 32 | B | 752 | 13[6] | 3950 | 250 | 60 | 1 |
| 33 | B | 752 | 3[6] | 3950 | 250 | 60 | 1 |
| 34 | D | 752 | 13[6] | 4200 | 250 | 90 | .56 |
| 35 | D | 752 | 3[6] | 3900 | 250 | 60 | 1 |
| 36[7] | A | 752 | 2 | 4300 | 400 | 60 | 1 |

[1]The samples corresponding to the letters are identified in Table 1.
[2]pounds per square inch gauge.
[3]hours, except where otherwise indicated.
[4]grams.
[5]This run was performed using as solid substrate the residue in the autoclave after flashing off the gas, water, and oil product from the run in Example 5.
[6]minutes.
[7]Additionally, the water contained 0.6 weight percent of soluble sodium carbonate catalyst.

TABLE 3

| | Product Composition[a] | | | | | | | | Sulfur Content[b] | | Nitrogen Content[b] | | Weight |
|---|---|---|---|---|---|---|---|---|---|---|---|---|---|
| | Gases | | | | | Liquids | | Spent | | | | | |
| Example | $CO_2$ | $H_2$ | $CH_4$ | $C_{2+}$ | Total | Oil | Bitumen | Shale | Oil | Bitumen | Oil | Bitumen | Balance[c] |
| 1 | 6.8 | d | 0.8 | 0.3 | 7.9 | 13.2 | 8.3 | 69.3 | 0.45 | 0.31 | d | d | 101.6 |
| 2 | 6.8 | d | 0.1 | d | 6.8 | 0.5 | 8.1 | 85.3 | d | d | d | d | 97.8 |
| 3 | 7.5 | d | 0.6 | 1.0 | 9.0 | 13.5 | 6.5 | 67.8 | d | d | d | d | 99.5 |
| 4 | 7.6 | d | 0.4 | 0.7 | 8.8 | 8.4 | 12.6 | 72.6 | d | d | d | d | 100.7 |
| 5 & 6[e] | 11 | d | 0.6 | 0.2 | 11.7 | 15.8 | 4.2 | 70.2 | d | d | d | d | 101.4 |
| 7 | f | f | f | f | 9.7 | 13.7 | 8.7 | 69.4 | d | d | d | d | 100.6 |
| 8 | f | f | f | f | 8.7 | 13.0 | 10.3 | 69.4 | d | d | d | d | 101.7 |
| 9 | f | f | f | f | 8.8 | 15.2 | 7.5 | 69.6 | d | d | d | d | 101.6 |
| 10 | f | f | f | f | 9.2 | 16.0 | 7.3 | 68.8 | d | d | d | d | 101.6 |
| 11 | f | f | f | f | 9.8 | 14.9 | 10.2 | 66.5 | d | d | d | d | 101.6 |
| 12 | 6.3 | 0.2 | 0.8 | d | 9.7 | 17.8 | 9.2 | 66.0 | 0.48 | 0.37 | 1.3 | 2.0 | 101.8 |
| 13 | 7.8 | 0.2 | 0.7 | d | 6.0 | 11.8 | 9.0 | 77.8 | 0.45 | 0.38 | 1.3 | 1.5 | 100.3 |
| 14 | 7.5 | 0.2 | 0.8 | d | 10.8 | 14.4 | 7.4 | 68.0 | d | d | d | d | 100.2 |
| 15 | 7.4 | 0.2 | 0.6 | d | 11.0 | 10.5 | 5.0 | 76.8 | d | d | d | d | 101.9 |
| 16 | 6.1[g] | 0.1[g] | 0.6[g] | d | — | 11.2 | 11.0 | 67.8 | d | d | d | d | — |
| 17 | 7.6 | 0.1 | 0.6 | d | 11.0 | 11.0 | 11.8 | 66.4 | 0.32 | 0.43 | 1.5 | 2.5 | 101.7 |
| 18 | 5.6 | d | 0.4 | d | 10.6 | 9.5 | 6.4 | 75.0 | 0.49 | 0.62 | 1.3 | 2.2 | 100.6 |
| 19 | 5.2 | d | 0.4 | d | 8.0 | 11.3 | 12.4 | 68.4 | 0.36 | 0.38 | 1.3 | 2.0 | 100.4 |
| 20 | 5.9 | 0.03 | 0.3 | d | 8.8 | 9.6 | 8.0 | 76.6 | 0.60 | 0.55 | 1.2 | 2.1 | 101.1 |
| 21 | 6.1 | 0.03 | 0.5 | d | 8.8 | 13.1 | 9.7 | 69.2 | 0.56 | 0.52 | 1.3 | 2.2 | 99.7 |
| 22 | 6.2 | d | 0.4 | d | 6.8 | 11.2 | 13.0 | 69.3 | 0.67 | 0.69 | 1.27 | 2.21 | 99.6 |
| 23 | 7.7[g] | 0.07[g] | 0.5[g] | d | 4.4[g] | 11.8 | 14.6 | 69.2 | 0.75 | 0.28 | 1.16 | 2.04 | — |
| 24 | d[g] | d[g] | d[g] | d | — | 7.2 | 9.0 | 74.6 | 0.80 | 0.46 | 1.13 | 1.94 | — |
| 25 | 8.0 | 0.025 | 0.6 | d | 10.8 | 8.8 | 6.1 | 76.0 | 0.51 | 0.53 | 1.72 | 2.10 | 100.3 |
| 26 | 6.8 | d | 0.4 | d | 7.8 | 6.4 | 6.5 | 78.4 | 0.81 | 0.65 | 1.37 | 2.04 | 99.7 |
| 27 | 6.0 | d | 0.2 | d | 6.2 | 4.4 | 5.0 | 87.3 | 1.06 | 0.84 | 1.38 | d | 100.0 |
| 28 | 6.3 | 0.025 | 0.4 | d | 8.6 | 7.0 | 10.0 | 76.0 | 0.42 | 0.37 | 1.28 | 2.16 | 100.2 |
| 29 | 4.4 | d | 0.23 | d | 7.9 | 7.0 | 17.5 | 65.2 | 0.86 | 0.52 | 1.16 | 2.41 | 100.6 |
| 30 | 3.9 | d | 0.18 | d | 7.1 | 5.6 | 13.4 | 71.3 | 0.68 | 0.58 | — | — | 99.5 |
| 31 | 3.0 | d | 0.07 | d | 7.2 | 4.0 | 10.7 | 80.0 | 0.93 | 0.69 | 1.03 | 1.83 | 101.5 |
| 32 | 6.9 | d | 0.19 | d | 8.3 | 5.5 | 7.6 | 78.7 | 0.57 | 0.37 | 1.38 | 1.68 | 100.3 |
| 33 | 3.0 | d | 0.07 | d | 6.3 | 5.8 | 8.3 | 79.2 | 0.77 | 0.46 | 1.00 | 2.17 | 100.1 |
| 34 | 6.5 | d | 0.19 | d | 8.3 | 6.3 | 5.7 | 80.9 | 0.70 | 0.42 | 1.14 | 2.09 | 100.5 |
| 35 | 2.8 | d | 0.07 | d | 5.7 | 5.7 | 9.8 | 81.8 | 0.80 | 0.53 | 0.90 | 2.20 | 100.5 |
| 36 | 7.3 | 0.2 | 0.6 | 0.3 | 6.0 | 17.3 | 6.5 | 71.7 | 0.43 | 0.37 | — | — | 101.5 |

[a]weight percent of oil shale feed.
[b]weight percent in the particular fraction.
[c]total weight percent of shale and water feeds and catalyst recovered as product and water.
[d]not determined.
[e]The run in Example 6 was performed using as solid substrate the residue in the autoclave after flashing off the gas, water, and oil product from the run in Example 5. The products from Examples 5 and 6 were combined.
[f]The gases were not separated.
[g]The gas recoveries are suspect because of leaks.

These results indicate that the elemental compositions of oils from different oil shales are quite similar. The weighted combined results for the oil and bitumen fractions from Examples 7–11 obtained using the method of this invention indicate that these fractions combined have a similar nitrogen content but a lower sulfur content than does the oil obtained using thermal retorting. The H/C atom ratios for oils obtained using the method of this invention are also similar to the H/C atom ratios for oils obtained by thermal retorting. However, the H/C atom ratio for the combined oil and bitumen fractions obtained using the method of this invention is less than that for the oil - that is, total liquid products - obtained by thermal retorting. This may reflect a larger total liquid yield obtained using the method of this invention than with thermolytic distillation. The combined oil fractions obtained in Examples 7 through 11 were characterized, and the results are shown in Table 5, along with comparable results reported in the literature for oil fractions obtained from oil shale by thermal retorting and gas combustion retorting. However, the olefin content of the oil fraction boiling up to 405° F. obtained by the method of this invention differs from the oil content of the oil fractions boiling up to 405° F. obtained by gas combustion retorting and by thermal retorting. The olefin content in this fraction obtained by the method of this invention is about half that in the corresponding fractions obtained by the thermal and gas combustion retorting processes. Clearly, while olefins are the primary products in this boiling fraction obtained by the thermal or gas combustion retorting of hydrocarbons, oils having a reduced olefin content are obtained by the method of this invention. This indicates that hydrogen is generated in situ in the method of this invention and that such hydrogen is at least partially consumed in the hydrogenation of recovered olefins.

TABLE 4

| Data from Example | Oil Shale Sample[1] | Fraction | Elemental Composition[2] Carbon | Hydrogen | Oxygen | Nitrogen | Sulfur | H/C Atom Ratio |
|---|---|---|---|---|---|---|---|---|
| 17 | C | oil | 83.5 | 11.3 | 3.3 | 1.6 | 0.3 | 1.62 |
| 18 | B | oil | 82.8 | 11.5 | 3.6 | 1.5 | 0.6 | 1.64 |
| 21 | A | oil | 83.1 | 11.3 | 3.5 | 1.5 | 0.7 | 1.63 |
| 7-11 | A | bitumen[3] | 82.2 | 10.1 | 4.8 | 2.4 | 0.5 | 1.46 |
| 7-11 | A | oil and bitumen[4] | 83.1[5] | 10.8[5] | 3.6[5] | 1.9[5] | 0.5[5] | 1.56[5] |
| — | — | oil[6] | 84.9[6] | 11.3[6] | — | 1.8[6] | 0.83[6] | 1.60[6] |
| — | — | kerogen[6] | 80.5[6] | 10.3[6] | 5.8[6] | 2.4[6] | 1.0[6] | 1.54[6] |
| — | — | raw shale[6] | 16.5[6] | 2.15[6] | — | 0.5[6] | 0.8[6] | 1.56 |

[1]The samples corresponding to the letters are identified in Table I.
[2]weight percent of the fraction.
[3]combined bitumen fractions from Examples 7-11.
[4]combined oil and bitumen fractions from Examples 7-11.
[5]weighted combination of the elemental compositions found for the oil and bitumen fractions individually.
[6]reported in M. T. Atwood, Chemtech, October, 1973, pages 617-621.

TABLE 5

| Component | Composition[1] of Liquid from: Method of this Invention | Thermal Retorting[2] | Gas Combustion Retorting[2] |
|---|---|---|---|
| bitumen fraction | 38 | | |
| oil fraction | 62 | | |
| acid in component | 3 | 3 | 4 |
| base in component | 14 | 8 | 8 |
| neutral oil | 45 | | |
| to 405°F. | 6 | 15 | 4 |
| paraffins and naphthenes | 48.5[3] | 27[3] | 27[3] |
| olefins | 20.0[3] | 48[3] | 51[3] |
| aromatics | 31.5[3] | 25[3] | 22[3] |
| 405° to 600°F. | 10 | | |
| paraffins and naphthenes | 35.5[3] | | |
| olefins | 24.0[3] | | |
| aromatics | 40.5[3] | | |
| 600 to 700°F. | 6 | | |
| residue (above 700°F.) | 23 | | |

[1]weight percent of liquid products except where otherwise indicated.
[2]Results were reported in G. O. Dinneen, R. A. Van Meter, J. R. Smith, C. W. Bailey, G. L. Cook, C. S. Allbright, and J. S. Ball, Bulletin 593, U.S. Bureau of Mines, 1961.
[3]volume percent of the particular boiling point fraction.

We have found that there exists a reasonable correlation of both the volumetric content of hydrocarbons in oil shale samples and the weight content of hydrocarbons in such samples with the weight loss of such samples during calcination in air at 1000° F. for 30 minutes. Both the volumetric and the weight contents of hydrocarbons are based on the Fischer assay described by L. Goodfellow, C. F. Haberman, and M. T. Atwood, "Modified Fischer Assay," Division of Petroleum Chemistry, Abstracts, page F. 86, American Chemical Society, San Francisco Meeting, April 2–5, 1968. This correlation is shown in FIG. 1.

Using this correlation, the expected yield of hydrocarbons from the oil shale samples we used was estimated in order to compare the actual yield of hydrocarbons with the expected total possible yield of hydrocarbons from the oil shale samples used. The weight loss during calcination of the oil shale samples used and the correlation shown in FIG. 1 indicate that the oil shale samples used would yield liquid products in the range of approximately 14 to 22 percent by weight of the oil shale feed.

Figure 2:
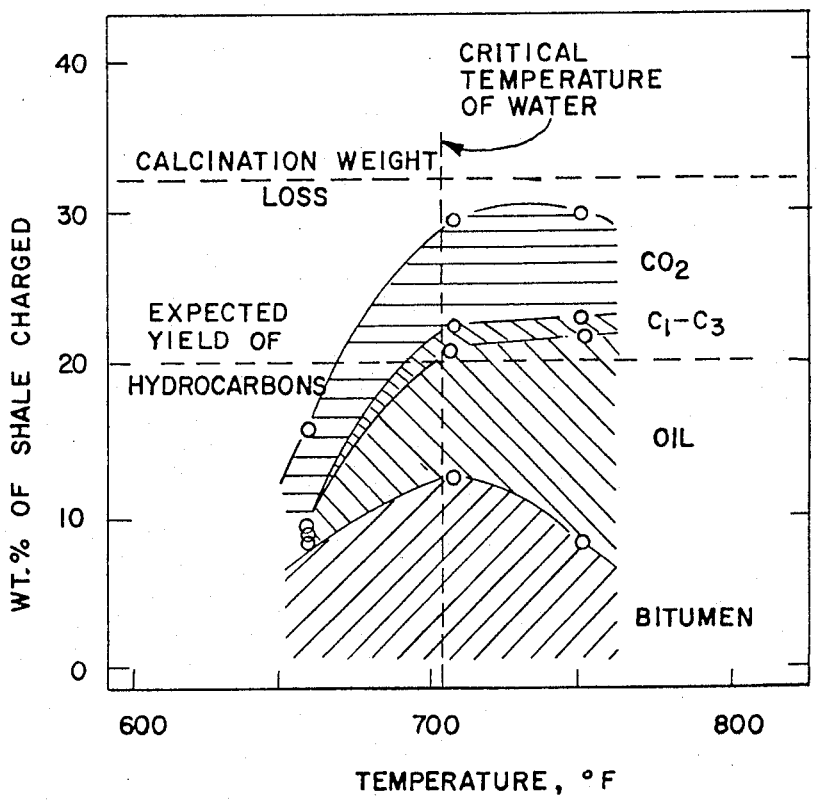
FIG. 2 is a series of plots showing the dependence on temperature of the yields of hydrocarbon products from oil shale using the method of this invention.

The actual weight loss during calcination of oil shale sample A, the expected yield of hydrocarbons in this oil shale sample, and the actual yields of oil, bitumen, and the gaseous products (carbon dioxide and $C_1$ to $C_3$ hydrocarbons) recovered in 2-hour batch runs of oil shale sample A at various temperatures are shown in FIG. 2. These runs were performed using shale-water weight ratios of either 0.56 or 1. When the ratio was 0.56, 90 grams of water were charged. When the ratio was 1, 60 grams of water were charged. The pressures ranged between 2550 and 4200 pounds per square inch gauge. The data plotted in FIG. 2 were taken from the results shown in Table 3. The liquid selectivity — the ratio of the total yield of liquid products to the weight loss of the oil shale sample during calcination — for oil shale sample A at 752° F. is 0.67. The oil selectivity — the ratio of the yield of oil to the total yield of liquid products — for oil shale sample A at 752° F. is 0.61.

The yield of oil recovered from oil shale by the method of this invention was markedly dependent on the temperature. The total liquid product yield — oil plus bitumen — was roughly constant at temperatures above 705° F. and dropped sharply at temperatures below 705° F. At temperatures above 705° F., the total liquid product yields accounted for, or even slightly exceeded the amount recoverable estimated by the Fischer assay. Although essentially all available hydrocarbon was removed from the oil shale by the method of this invention at a temperature of at least 705° F., the amounts of lighter hydrocarbon fractions recovered continued to increase as the temperature was increased above 705° F. This is evidenced in FIG. 2 by the sharp increase in the oil yield and decrease in the bitumen yield as the temperature is increased above 705° F. Such an increase in the oil yield and decrease in the bitumen yield is reasonable if cracking — either thermal or catalytic through the presence of catalysts intrinsically present in the oil shale — of the bitumen were occurring.

Similar results, shown in Table 6, were obtained in Examples 1, 2, 15, and 26 - 28 with different contact times and with oil shale samples of different particle size ranges than those used in obtaining the results shown in FIG. 2. These results indicate that even at a temperature of 698° F., slightly below the critical temperature for water, the liquid and oil selectivities were substantially reduced from the values obtained at temperatures above the critical temperature of water.

Figure 3:
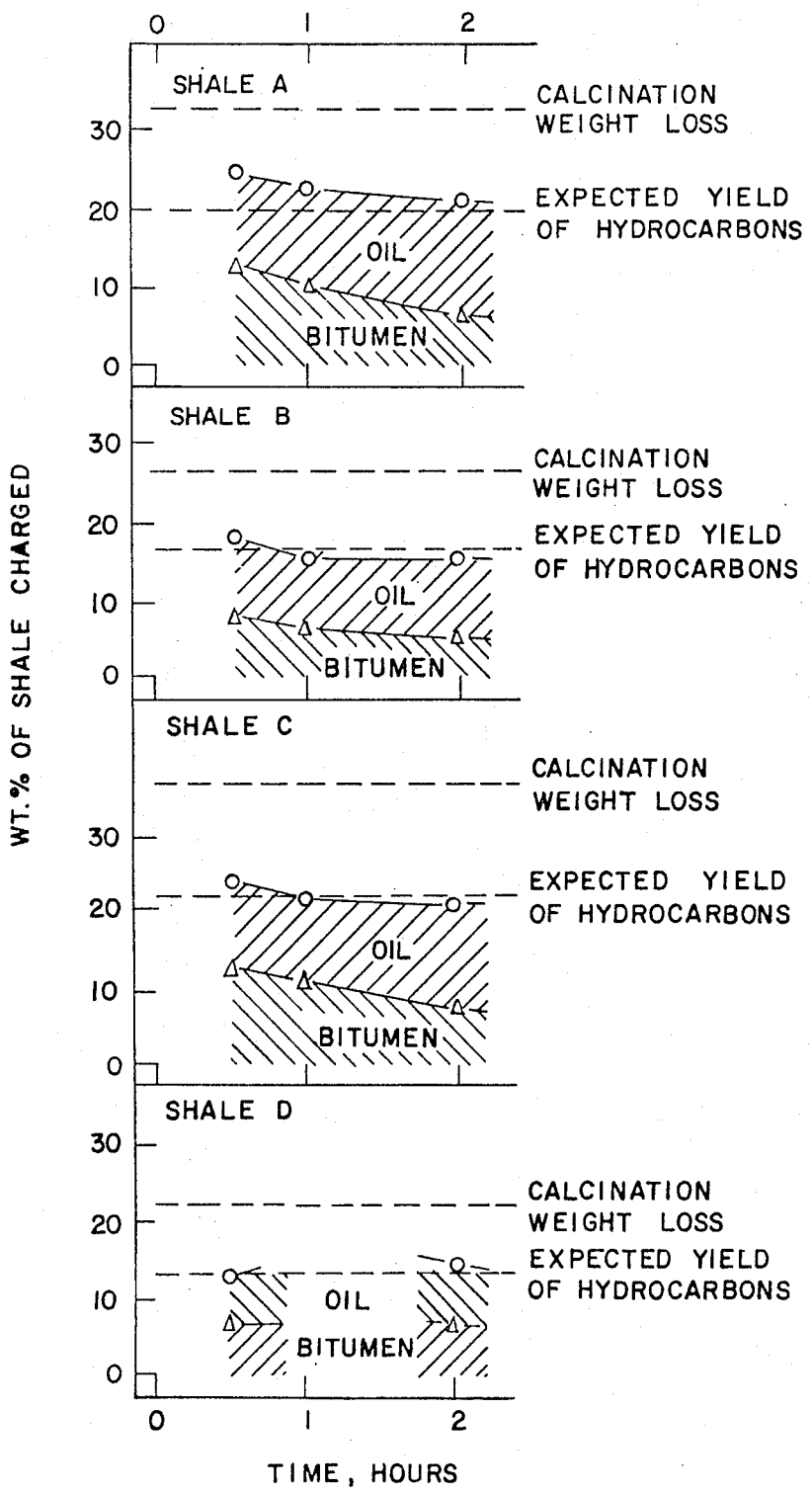
FIG. 3 is a series of plots showing the dependence of the yields of oil and bitumen from oil shale upon the particle size of the oil shale and upon the contact time using the method of this invention.
Figure 4:
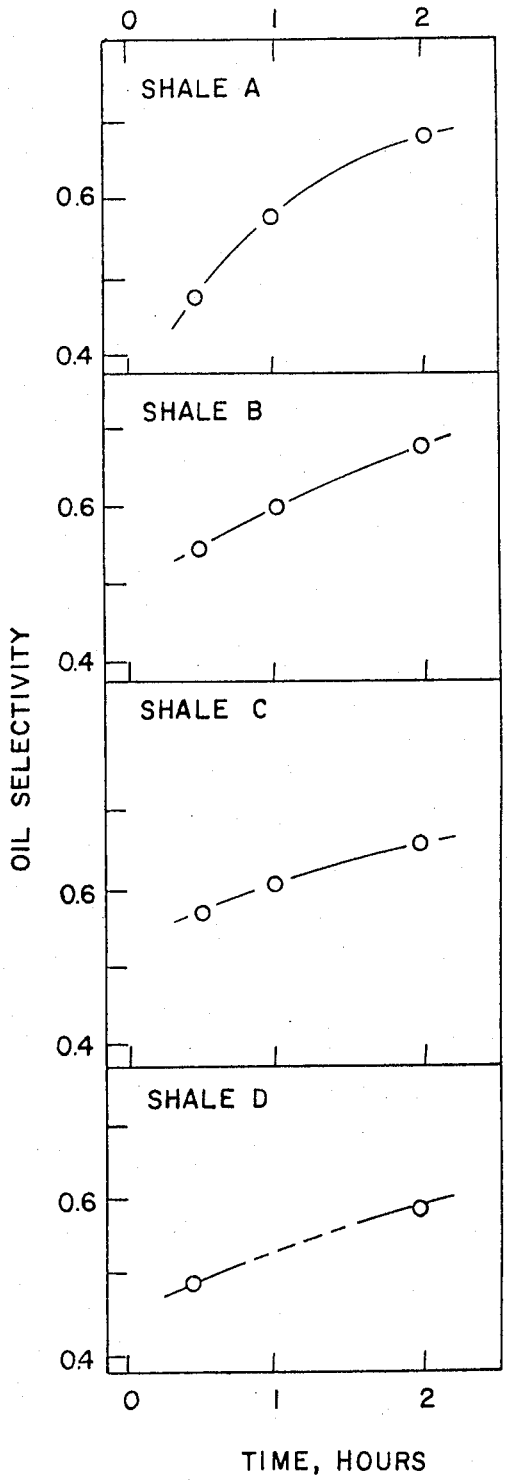
FIG. 4 is a series of plots showing the dependence of the oil selectivity upon the particle size of the oil shale and upon the contact time using the method of this invention.

Results showing the effect of the particle size of the oil shale substrate on the rate of recovery of hydrocarbons from oil shale are presented in FIGS. 3 and 4. The plots in FIGS. 3 and 4 were obtained using the results shown in Table 3, for runs involving a shale-to-water weight ratio of 0.56.

TABLE 6

| Data from Example | Oil Shale Sample[1] | Reaction Temperature (°F.) | Reaction Time (hours) | Liquid Selectivity | Oil Selectivity |
|---|---|---|---|---|---|
| 2 | A | 660 | 2 | 0.27 | 0.06 |
| 1 | A | 752 | 2 | 0.67 | 0.61 |
| 28 | B | 716 | 2 | 0.63 | 0.41 |
| 15 | B | 752 | 2 | 0.58 | 0.68 |
| 27 | D | 698 | 0.5 | 0.42 | 0.47 |
| 26 | D | 752 | 0.5 | 0.58 | 0.50 |

[1]The samples corresponding to the letters are identified in Table 1.

The weight loss during calcination, the expected yield of hydrocarbons from the oil shale sample, and the measured yield of liquid hydrocarbon products — all being expressed as weight percent of the oil shale feed — are shown in FIG. 3 as a function of the contact time and of the range of particle sizes of the oil shale feed. Generally, with oil shale feed having a particle size of approximately ¼ inch diameter or less, more than 90 weight percent of the carbonaceous content of the oil shale feed was recovered in less than one-half hour. When the oil shale feed had a particle size equal to or smaller than 8 mesh, the yield of total liquid products was greater after a contact time of one-half hour than after a contact time of two hours, and exceeded the expected yield of hydrocarbons from the oil shale. For such feed, the decline of total yield of the liquid hydrocarbon products with increasing contact time corresponded to increased conversion of the liquid products to dry gas, for example by cracking the liquid products. Cracking was also indicated by the plots in FIG. 4 showing the oil selectivity as a function of the contact time and of the range of the particle sizes of the oil shale feed.

When the oil shale feed had a particle size in the range of from ¼ inch to ½ inch, the rate of recovery was low enough so that the total yield of liquid products after a contact time of one-half hour was less than the total yield of liquid products after a contact time of two hours. This is indicated in FIG. 3. While no theory for this is proposed, if the oil shale feed is made up of coarser materials having a larger particle size, the ratio of surface area to particle volume for such materials would be lower than that for finer materials, and diffusion of water into the coarser oil shale particles and the rate of dissolution of the inorganic matrix in the supercritical water may decrease, and, hence, the rate of recovery may decrease.

There is evidence that efficient recovery of liquids from oil shale by the method of this invention involves partial dissolution of the inorganic matrix of the oil shale substrate. Following complete recovery of liquids from oil shale feeds having particle sizes in the range of ¼ inch diameter to 80 mesh, the spent oil shale solids recovered had substantially smaller particle sizes, generally less than 100 mesh. Further, there was also a decrease in the bulk density from about 2.1 grams per milliliter for the feed to about 1.1 grams per milliliter for the spent solids. On the other hand, when the liquids were not completely recovered from the oil shale feed, the oil shale particles retained much of their starting conformation. For example, little apparent conformational change occurred for oil shale feed when only half of the carbonaceous material was removed from it.

There is additional evidence of the decomposition of the inorganic matrix of the oil shale substrate during recovery of liquid hydrocarbons by the method of this invention. The high yield of carbon dioxide from the recovery of liquid hydrocarbons from oil shale, even at the relatively low temperature of 660°F., indicates decomposition of the inorganic carbonate in the structure of oil shale. The approximate mass balance of the oil shale feed and of the combined products from the recoveries in Examples 7–11 of liquid hydrocarbons from the oil shale sample A demonstrate that carbon dioxide is formed from inorganic carbonate and is presented in Table 7.

The relationships by which the products were characterized are presented hereinafter. The total amount, $S_O$, of oil shale feed, excluding entrained water, is given as follows:

$$S_O = S + I_C + K_C$$

wherein the symbols used are defined in Table 7.

TABLE 7

| Component | Component Symbol | Weight % of the Feed |
|---|---|---|
| | Oil Shale Feed | |
| Kerogen | $K_C$ | 32 |
| Acid-titratable inorganic carbonate | $I_C$ | 19 |
| Inorganic solid, excluding acid titratable inorganic carbonate | S | 49 |
| | | 100 |
| | Recovery Product | |
| Dry gas | $K_G$ | 1 |
| Oil and bitumen | $K_{OB}$ | 23 |
| Carbon dioxide | | 7 |
| Kerogen coke | $yK_C$ | 4 |
| Acid-titratable inorganic carbonate | $xI_C$ | 15 |
| Inorganic solid, | S | 50 |

TABLE 7-continued

| Component | Component Symbol | Weight % of the Feed |
|---|---|---|
| excluding acid-titratable inorganic carbonate | | |
| Total | | 100 |

When the oil shale feed was titrated with acid, the amount of acid-tritratable, inorganic carbonate initially present, $I_C$, in the oil shale feed was determined, and thus the relationship between the measured amount of acid-titratable inorganic carbonate initially present and the measured total amount of oil shale feed could be expressed. Such relationship for oil shale sample A was $$I_C = 0.187\ S_O$$

When the oil shale feed was calcined in air for 30 minutes at 1000°F., all organic material was driven off, and the measured weight of total inorganic material could be expressed in terms of the total amount of oil shale feed as follows:

$$S + I_C = 0.678\ S_O$$

From the last two equations, S was be calculated to be 0.491 $S_O$.

The solid products obtained in the recovery of hydrocarbons from the oil shale feed by the method of this invention are given as follows:

$$S + xI_C + yK_C = 0.686\ S_O$$

wherein the symbols used are defined in Table 7. The conditions employed in this run were a temperature of 752°F., a pressure of approximately 4000 pounds per square inch gauge, a time of 2 hours, a charge of water of 60 grams, and a shale-to-water weight ratio of 1.0.

When the spent oil shale solid residue was titrated with acid, the amount of acid-titratable inorganic carbonate present in the spent solid after the run could be determined, and the relationship between the measured amount of acid-titratable inorganic carbonate present after removal of the hydrocarbons, $xI_C$, and the measured total amount of oil shale measured could be expressed as follows $$xI_C = 0.147\ S_O$$

where $x$ is the fraction of the amount initially present, $I_C$, which is still remaining.

When the spent oil shale solid was calcined in air for 30 minutes at 1000°F., all organic material was driven off, and the measured weight of total organic material remaining after removal of the hydrocarbons could be expressed in terms of the total amount of oil shale as follows:

$$S + xI_C = 0.643\ S_O$$

From the last two equations, S was calculated to be 0.496 $S_O$. This value corresponds closely to the value of $S$ calculated from the analytical characterization of the oil shale feed.

A very significant result from the analytical characterization shown in Table 7 is that the amount of acid-titratable inorganic carbonate in the solid spent oil shale was markedly lower than the amount of acid-titratable inorganic carbonate in the oil shale feed, and the difference between such amounts could account for between 50–60 weight percent of the gaseous carbon dioxide produced. Carbon dioxide derived from the kerogen in the oil shale feed could also account for some of the remainder. Generally, inorganic carbonate in the structure of oil shale survives thermal processing if the temperature is kept no higher than 1000°F. Thus, thermal or gas combustive retorting does not normally reduce the amount of acid-titratable inorganic carbonate. On the contrary, the amount of acid-titratable inorganic carbonate in the structure of oil shale was reduced by the method of this invention.

Results from 2-hour batch runs at 752°F. showing the effect of the weight ratio of oil shale feed-to-solvent on the total yield of liquid products and an oil selectivity are presented in Table 8. The recovery was complete under the conditions employed when the weight ratio of oil shale feed-to-solvent was in the range of from about 1:1 to about 1:2. A weight ratio in this range also permits fluid transfer and compression of the oil shale feed-solvent mixture so that a continuous slurry processing system is possible.

Example 37 involves a batch recovery of hydrocarbons from raw tar sands using the method of this invention. The condition employed were a reaction temperature of 752°F., a reaction time of 2 hours, a reaction pressure of 4100 pounds per square inch gauge, and an argon pressure of 250 pounds per square inch gauge.

TABLE 8

| Results from Example | Oil Shale Sample[1] | Oil Shale -to Water Weight Ratio | Expected Total Hydrocarbon Yield | Weight % of Feed Recovered as Oil | Bitumen |
|---|---|---|---|---|---|
| 1 | A | 1.0 | 22 | 13.2 | 8.3 |
| 3 | A | 0.6 | 22 | 13.5 | 6.5 |
| 13 | B | 1.0 | 16 | 11.8 | 9.0 |
| 15 | B | 0.6 | 16 | 10.5 | 5.0 |
| 12 | C | 1.0 | 22 | 17.8 | 9.2 |
| 14 | C | 0.6 | 22 | 14.4 | 7.4 |

[1]The samples corresponding to the letters are identified in Table 1.

The feed was made up of 40 grams of raw tar sands in 90 grams of water. This run was performed in a 300-milliliter Hastelloy alloy C Magne-Drive autoclave. The products of this recovery included gas (hydrogen, carbon dioxide, and methane) and oil in amounts equivalent to 2 and 8 weight percent of the feed, respectively. The oil had an API gravity of about 17.0 and sulfur, nickel, and vanadium contents of 2.7 weight percent, and 45 and 30 parts per million, respectively. On the contrary, tar sands oil obtained by the COFCAW process had an API gravity of 12.2 and sulfur, nickel, and vanadium contents of 4.6 weight percent, and 74 and 182 parts per million, respectively. Hence, the oil obtained by the method of this invention is upgraded relative to the oil produced by the COFCAW process.

Further, the yields of gas, oil, bitumen, and solid products in this Example were 2.5, 3.7, 3.4, and 86.5 weight percent of the tar sands feed. This represents essentially complete recovery of the hydrocarbon content of the tar sands feed. The total amount of gas, oil, bitumen, and solid fractions and of water recovered constituted 97.4 weight percent of the tar sands and water feeds.

EXAMPLES 38–51

Examples 38–51 involve batch processing of different types of hydrocarbon feedstocks under a variety of conditions and illustrate that the method of this invention effectively cracks, desulfurizes, and demetalates hydrocarbons and therefore that the hydrocarbons recovered from the oil shale or tar sands are also cracked, desulfurized, and demetalated in the method of this invention. Unless otherwise specified, the following procedure was used in each case. The hydrocarbon feed, water, and catalyst, if any, were loaded at ambient temperature into a 300-milliliter Hastelloy alloy C Magne-Drive autoclave in which the reaction mixture was to be mixed. The components of the catalyst system were added as solutes in the water or as solids in slurries in the water. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660°F. Approximately 6 minutes were required to raise the temperature from 660°F. to 700°F. Approximately another 6 minutes were required to raise the temperature from 700°F. to 750°F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized and was flash-distilled from the reaction vessel, removing the gas, water, and "light" ends, and leaving the "heavy" ends and other solids, including the catalyst, if present, in the reaction vessel. The "light" ends were the hydrocarbon fraction boiling at or below the reaction temperature and the "heavy" ends were the hydrocarbon fraction boiling above the reaction temperature.

The gas, water, and light ends were trapped in a pressure vessel cooled by liquid nitrogen. The gas was removed by warming the pressure vessel to room temperature and then was analyzed by mass spectroscopy, gas chromatography, and infra-red. The water and light ends were then purged from the pressure vessel by means of compressed gas and occasionally also by heating the vessel. Then the water and light ends were separated by decantation. Alternately, this separation was postponed until a later stage in the procedure. Gas chromatograms were run on the light ends.

The heavy ends and solids, including the catalyst, if present, were washed from the reaction vessel with chloroform, and the heavy ends dissolved in this solvent. The solids were then separated from the solution containing the heavy ends by filtration.

After separating the chloroform from the heavy ends by distillation, the light ends and heavy ends were combined. If the water had not already been separated from the light ends, then it was separated from the combined light and heavy ends by centrifugation and decantation. The combined light and heavy ends were analyzed for their nickel, vanadium, and sulfur content, carbon-hydrogen atom ratio (C/H), and API gravity. The water was analyzed for nickel and vanadium, and the solids were analyzed for nickel, vanadium, and sulfur. X-ray fluoresence was used to determine nickel, vanadium, and sulfur.

Examples 38–42 involve straight tar sands oil, and Examples 43–46 involve topped tar sands oil. Topped tar sands oil is the straight tar sands oil used in Examples 38–42 but from which approximately 25 weight percent of light material has been removed. Examples 47–50 involve C vacuum atmospheric residual oil. Example 51 involves C vacuum residual oil. The compositions of the hydrocarbon feeds employed are shown in Table 9. The experimental conditions used and the results of analyses of the products obtained in these Examples are shown in Tables 10 and 11, respectively.

TABLE 9

| Components | Tar Sands Oils Straight | Tar Sands Oils Topped | Atmospheric Residual Oils Khafji | Atmospheric Residual Oils C | Atmospheric Residual Oils Cyrus | C Vacuum Residual Oil |
|---|---|---|---|---|---|---|
| Sulfur[1] | 4.56 | 5.17 | 3.89 | 3.44 | 5.45 | 4.64 |
| Vanadium[2] | 182 | 275 | 93 | 25 | 175 | 54 |
| Nickel[2] | 74 | 104 | 31 | 16 | 59 | 34 |
| Carbon[1] | 83.72 | 82.39 | 84.47 | 85.04 | 84.25 | 84.88 |
| Hydrogen[1] | 10.56 | 9.99 | 10.99 | 11.08 | 10.20 | 10.08 |
| H/C atom ratio | 1.514 | 1.455 | 1.56 | 1.56 | 1.45 | 1.43 |
| API gravity[3] | 12.2 | 7.1 | 14.8 | 15.4 | 9.8 | 5.4 |
| Liquid fraction,[1] boiling up to 650°F. | 29.4 | 9.7 | 10.6 | 12.0 | 6.9 | 9.1 |

[1]weight percent.
[2]parts per million.
[3]°API.

TABLE 10

| Example | Reaction Time[1] | Reaction Temperature[2] | Reaction Pressure[3] | Argon Pressure[3] | Catalyst | Amount of Catalyst Added[4] | Amount of Water[4] | Hydrocarbon-to-Water Weight Ratio |
|---|---|---|---|---|---|---|---|---|
| 38 | 6 | 752 | 4400 | 450 | — | — | 90 | 1:3 |
| 39 | 3 | 752 | 4350 | 400 | — | — | 90 | 1:3 |
| 40 | 1 | 752 | 4350 | 400 | — | — | 90 | 1:3 |
| 41 | 2 | 752 | 4200 | 400 | NaOH | 0.04 | 80 | 1:3 |
| 42 | 1 | 752 | 4300 | 400 | $MnO_2$ | 0.30 | 91 | 1:3 |
| 43 | 1 | 752 | 4300 | 400 | — | — | 90 | 1:3 |
| 44 | 3 | 752 | 4300 | 400 | — | — | 90 | 1:3 |
| 45 | 2 | 752 | 4350 | 400 | NaOH | 0.04 | 80 | 1:3 |
| 46 | 1 | 752 | 4250 | 400 | $MnO_2$ | 0.30 | 90 | 1:3 |
| 47 | 1 | 752 | 4450 | 400 | KOH | 0.5 | 90 | 1:3 |
| 48 | 1 | 752 | 4550 | 400 | KOH | 1 | 90 | 1:3 |
| 49 | 6 | 710 | 2600 | 450 | — | — | 30 | 4:1 |
| 50 | 6 | 710 | 3600 | 450 | — | — | 90 | 1:3 |
| 51 | 1 | 752 | 4150 | 400 | KOH | 1 | 90 | 1:3 |

[1]hours.
[2]°F.
[3]pounds per square inch gauge.
[4]grams.

TABLE 11

| Example | Product Composition[1] Gas | Light Ends | Heavy Ends | Solids | Percent Removal of[2] Sulfur | Nickel | Vanadium | H/C Atom Ratio | API Gravity[3] | Weight Balance[4] |
|---|---|---|---|---|---|---|---|---|---|---|
| 38 | 3.7 | 84.2 | 5.7 | 6.4 | 56 | — | — | — | — | 97.2 |
| 39 | 11.2 | 75.2 | 8.6 | 5.0 | 63 | 95 | 74 | 1.451 | 20.5 | 100.2 |
| 40 | 1.3 | 70.6 | 27.1 | 1.0 | 36 | 69 | 77 | 1.362 | 20.5 | 99.4 |
| 41 | 2.7 | 72.1 | 23.0 | 2.2 | 74 | 85 | 82 | — | — | 99.7 |
| 42 | 7.7 | 68.6 | 22.4 | 1.3 | 80 | 80 | 96 | — | — | 99.8 |
| 43 | 1.0 | 62.9 | 39.4 | 0.1 | 39 | 42 | 75 | — | — | 99.9 |
| 44 | 5.9 | 67.2 | 20.0 | 6.9 | 49 | 77 | 96 | 1.418 | 12.5 | 99.7 |
| 45 | 5.0 | 59.9 | 32.2 | 2.9 | 37 | 91 | 92 | — | — | 100.0 |
| 46 | 5.7 | 59.8 | 33.2 | 1.3 | 80 | 86 | 93 | — | — | 100.3 |
| 47 | 1.3 | 54.3 | 36.9 | 7.5 | 79 | — | 92 | — | — | 100.6 |
| 48 | 2.0 | 51.7 | 39.7 | 6.7 | 82 | — | 90 | — | — | 101.1 |
| 49 | 2.5 | 35.3 | 62.1 | 0.7 | 30 | — | — | — | — | 98.4 |
| 50 | 4.7 | 53.0 | 38.0 | 1.3 | 32 | — | — | — | — | 100.7 |
| 51 | 1.3 | 29.7 | 60.8 | 8.2 | 90 | 96 | 24 | — | — | 100.1 |

[1]weight percent of hydrocarbon feed.
[2]These values were obtained from analyses of the combined light and heavy ends.
[3]°API.
[4]total weight percent of hydrocarbon and water feeds and catalyst recovered as product and water.

A 300-milliliter Hastelloy alloy C Magne-Drive autoclave was employed as the reaction vessel in these Examples.

Comparison of the results shown in Table 11 indicates that desulfurization and demetalation of the hydrocarbon feed occurred and that the hydrocarbon feed was cracked, producing gases, light ends, heavy ends, and solid residue, even when no catalyst was added from an external source. In such case, the extent of removal of sulfur and metals increased when the reaction time was increased from 1 to 3 hours. Beyond that time, the extent of desulfurization decreased with increasing reaction time. Addition of a catalyst substantially increased the extent of desulfurization and demetalation.

When the water density was at least 0.1 gram per milliliter — for example, when the hydrocarbon fraction-to-water weight ratio was 1:3 — the sulfur which was removed from the hydrocarbon feed appeared as elemental sulfur and as sulfur dioxide or as hydrogen sulfide. At lower water densities — for example, when the hydrocarbon-to-water weight ratio was 4:1 — part of the removed sulfur appeared as hydrogen sulfide. This clearly indicates a change in the mechanism of desulfurization of organic compounds on contact with a dense-water-containing phase, depending upon the water density of the dense-water-containing phase. Further, when the hydrocarbon fraction-to-water weight ratio was 4:1, there was an adverse shift in the distribution of hydrocarbon products and a lesser extent of desulfurization.

The total weight percent of gases and compositions of the gas products obtained in several of the Examples are indicated in Table 12. In all cases, the main component of the gas products was argon which was used in the pressurization of the reactor and which is not reported in Table 12. Generally, increasing the reaction time resulted in increased yields of gaseous products.

TABLE 12

| Example | Reaction Time[1] | Composition of the Gas Products[2] Hydrogen | Carbon Dioxide | Methane | Total Weight Percent of Gas |
|---|---|---|---|---|---|
| 39 | 3 | 3.3 | 5.2 | 6.9 | 11.2 |
| 40 | 1 | 2.8 | 3.1 | 3.4 | 1.3 |
| 43 | 1 | 1.0 | 3.8 | 8.4 | 1.0 |
| 44 | 3 | 3.0 | 5.6 | 7.5 | 5.9 |

[1]hours.
[2]mole percent of gas.

Successive exposure of the catalysts of this invention to hydrocarbons containing sulfur contaminants did not cause a decrease in the catalytic efficiency of the catalysts.

EXAMPLES 52–61

Figure 5:
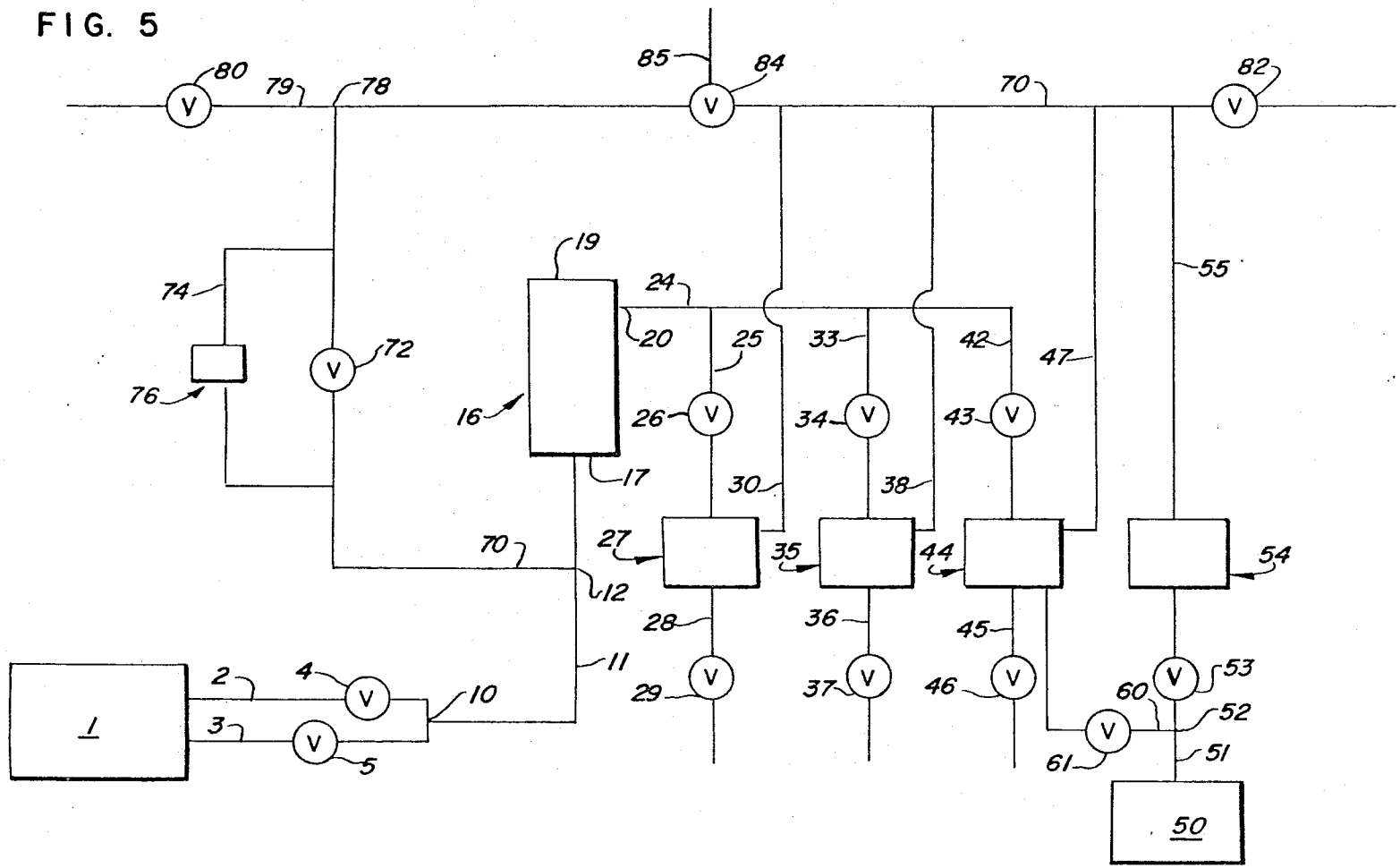
FIG. 5 is a schematic diagram of the flow system used for semicontinuously processing a hydrocarbon fraction.

Examples 52–61 involve semi-continuous flow processing at 752°F. of straight tar sands oil under a variety of conditions. The flow system used in these Examples is shown in FIG. 5. To start a run, ⅛-inch diameter inert, spherical alundum balls or irregularly shaped, catalytic titanium oxide chips having 2 weight percent of ruthenium deposited thereon were loaded into a 21.5-inch long, 1-inch outside diameter, and 0.25-inch inside diameter vertical Hastelloy alloy C pipe reactor 16. The alundum balls served merely to provide an inert surface on which metals to be removed from the hydrocarbon feed could deposit. Top 19 was then closed, and a furnace (not shown) was placed around the length of pipe reactor 16. Pipe reactor 16 had a total effective heated volume of approximately 12 milliliters, and the packing material had a total volume of approximately 6 milliliters, leaving approximately a 6-milliliter free effective heated space in pipe reactor 16.

All valves, except 53 and 61, were opened, and the flow system was flushed with argon or nitrogen. Then, with valves 4, 5, 29, 37, 46, 53, 61, and 84 closed and with Annin valve 82 set to release gas from the flow system when the desired pressure in the system was exceeded, the flow system was brought up to a pressure in the range of from about 1000 to about 2000 pounds per square inch gauge by argon or nitrogen entering the system through valve 80 and line 79. Then valve 80 was closed. Next, the pressure of the flow system was brought up to the desired reaction pressure by opening valve 53 and pumping water through Haskel pump 50 and line 51 into water tank 54. The water served to further compress the gas in the flow system and thereby to further increase the pressure in the system. If a greater volume of water than the volume of water tank 54 was needed to raise the pressure of the flow system to the desired level, then valve 61 was opened, and additional water was pumped through line 60 and into dump tank 44. When the pressure of the flow system reached the desired pressure, valves 53 and 61 were closed.

A Ruska pump 1 was used to pump the hydrocarbon fraction and water into pipe reactor 16. The Ruska pump 1 contained two 250-milliliter barrels (not shown), with the hydrocarbon fraction being loaded into one barrel and water into the other, at ambient temperature and atmospheric pressure. Pistons (not shown) inside these barrels were manually turned on until the pressure in each barrel equaled the pressure of the flow system. When the pressures in the barrels and in the flow system were equal, check valves 4 and 5 opened to admit hydrocarbon fraction and water from the barrels to flow through lines 2 and 3. At the same time, valve 72 was closed to prevent flow in line 70 between points 12 and 78. Then the hydrocarbon fraction and water streams joined at point 10 at ambient temperature and at the desired pressure, flowed through line 11, and entered the bottom 17 of pipe reactor 16. The reaction mixture flowed through pipe reactor 16 and exited from pipe reactor 16 through side arm 24 at point 20 in the wall of pipe reactor 16. Point 20 was 19 inches from bottom 17.

With solution flowing through pipe reactor 16, the furnace began heating pipe reactor 16. During heat-up of pipe reactor 16 and until steady state conditions were achieved, valves 26 and 34 were closed, and valve 43 was opened to permit the mixture in side arm 24 to flow through line 42 and to enter and be stored in dump tank 44. After steady state conditions were achieved, valve 43 was closed, and valve 34 was opened for the desired period of time to permit the mixture in side arm 24 to flow through line 33 and to enter and be stored in product receiver 35. After collecting a batch of product in product receiver 35 for the desired period of time, valve 34 was closed, and valve 26 was opened to permit the mixture in side arm 24 to flow through line 25 and to enter and be stored in product receiver 27 for another period of time. Then valve 26 was closed.

The material in side arm 24 was a mixture of gaseous and liquid phases. When such mixture entered dump tank 44, product receiver 35, or product receiver 27, the gaseous and liquid phases separated, and the gases exited from dump tank 44, product receiver 35, and product receiver 27 through lines 47, 38, and 30, respectively, and passed through line 70 and Annin valve 82 to a storage vessel (not shown).

When more than two batches of product were to be collected, valve 29 and/or valve 37 was opened to remove product from product receiver 27 and/or 35, respectively, to permit the same product receiver and/or receives to be used to collect additional batches of product.

At the end of a run — during which the desired number of batches of proudct were collected — the temperature of pipe reactor 16 was lowered to ambient temperature, and the flow system was depressurized by opening valve 84, in line 85 venting to the atmosphere.

Diaphragm 76 measured the pressure differential across the length of pipe reactor 16. No solution flowed through line 85.

The API gravity of the liquid hydrocarbon products collected was measured, and their nickel, vanadium, and iron contents were determined by x-ray fluorescence.

The properties of the straight tar sands oil feed employed in Examples 52–61 are shown in Table 9. The tar sands oil feed contained 300–500 parts per million of iron, and the amount of 300 parts per million was used to determine the percent iron removed from the product. The experimental conditions and characteristics of the products formed in these Examples are presented in Table 13. The liquid hourly space velocity (LHSV) was calculated by dividing the total volumetric flow rate, in milliliters per hour, of water and oil feed passing through pipe reactor 16 by the volumetric free space in pipe reactor 16 — that is, 6 milliliters.

TABLE 13

| | Example 52 | Example 53 | Example 54 | Example 55 | Example 56 | Example 57 | Example 58 | Example 59 | Example 60 | Example 61 |
|---|---|---|---|---|---|---|---|---|---|---|
| Reaction pressure[1] | 4100 | 4040 | 4060 | 4080 | 4100 | 4100 | 4100 | 4100 | 4020 | 4040 |
| LHSV[2] | 1.0 | 1.0 | 1.0 | 1.0 | 2.0 | 2.0 | 2.0 | 2.0 | 2.0 | 2.0 |
| Oil-to-water volumetric flow rate ratio | 1:3 | 1:3 | 1:3 | 1:3 | 1:2 | 1:2 | 1:3 | 1:3 | 1:3 | 1:3 |
| Packing material | alundum | Ru, Ti | Ru, Ti | Ru, Ti | alundum | alundum | alundum | alundum | Ru, Ti | Ru, Ti |

TABLE 13-continued

| | Example 52 | Example 53 | Example 54 | Example 55 | Example 56 | Example 57 | Example 58 | Example 59 | Example 60 | Example 61 |
|---|---|---|---|---|---|---|---|---|---|---|
| Product collected during period number[3] | 3 | 2 | 4 | 5 | 1 | 2 | 1 + 2 | 3 | 2 | 3 |
| Product characteristics | | | | | | | | | | |
| API gravity[4] | 21.0 | 21.0 | 23.0 | 20.0 | 17.8 | 17.3 | 21.0 | 22.9 | 20.0 | 20.0 |
| Percent nickel removed | 95 | 77 | 84 | 69 | 97 | 69 | 64 | 69 | 69 | 93 |
| Percent vanadium removed | 97 | 81 | 96 | 99 | 59 | 54 | 73 | 59 | 60 | 77 |
| Percent iron removed | 98 | 99 | 98 | 92 | — | — | 99 | 99 | 98 | 98 |

[1]pounds per square inch gauge.
[2]hours$^{-1}$.
[3]The number indicates the 7–8 hour period after start-up and during which feed flowed through pipe reactor 16.
[4]°API.

The flow process employed in Examples 52–61 could also be modified so as to permit pumping a slurry of oil shale or tar sands solids in a water-containing fluid through pipe reactor 16. In such case, the alundum balls would not be present in pipe reactor 16, and dump tank 44 and product receivers 27 and 35 could be equipped with some device, for example a screen, to separate the spent solids from the recovered hydrocarbon product. Alternately, pipe reactor 16 could be packed with oil shale or tar sands solids instead of or in addition to the packing materials used in Examples 52–61. Thus, continuous and semi-continuous flow processing could be used in the recovery process itself.

The above examples are presented by way of illustration, and the invention should not be construed as limited thereto.

The various components of the catalyst system of the method of this invention do not possess exactly identical effectiveness. The most advantageous selection of components and concentrations thereof in the particular catalyst system to be used will depend on the particular solid being processed.

We claim:

1. A process for recovering hydrocarbons from oil shale or tar sands solids and simultaneously for cracking, desulfurizing, and demetalating the recovered hydrocarbons, comprising contacting the oil shale or tar sands solids with a water-containing fluid under superatmospheric pressure, at a temperature in the range of from about 600°F. to about 900°F., in the absence of externally supplied hydrogen, and in the presence of an externally supplied, sulfur-resistant catalyst, selected from the group consisting of at least one basic metal carbonate, basic metal hydroxide, transition metal oxide, oxide-forming transition metal salt, and combinations thereof, wherein said catalyst is present in a catalytically effective amount, wherein the transition metal in the oxide and salt is selected from the group consisting of the transition metals of Groups IVB, VB, VIB, and VIIB; wherein the metal in the basic metal carbonate and hydroxide is selected from the group consisting of alkali metals; wherein sufficient water is present in the water-containing fluid and said pressure is sufficiently high so that the water in the water-containing fluid has a density of at least 0.10 gram per milliliter and serves as an effective solvent for the recovered hydrocarbons; and lowering said temperature or pressure or both, to thereby make the water in the water-containing fluid a less effective solvent for such hydrocarbons and to thereby form separate phase.

2. The process of claim 1 wherein the density of water in the water-containing fluid is at least 0.15 gram per milliliter.

3. The process of claim 2 wherein the density of water in the water-containing fluid is at least 0.2 gram per milliliter.

4. The process of claim 1 wherein the temperature is at least 705°F.

5. The process of claim 1 wherein the oil shale or tar sands solids are contacted with the water-containing fluid for a period of time in the range of from about 1 minute to about 6 hours.

6. The process of claim 5 wherein the oil shale or tar sands solids are contacted with the water-containing fluid for a period of time in the range of from about 5 minutes to about 3 hours.

7. The process of claim 6 wherein the oil shale or tar sands solids are contacted with the water-containing fluid for a period of time in the range of from about 10 minutes to about 1 hour.

8. The process of claim 1 wherein the weight ratio of oil shale or tar sand solids-to-water in the water-containing fluid is in the range of from about 3:2 to about 1:10.

9. The process of claim 8 wherein the weight ratio of oil shale or tar sand solids-to-water in the water-containing fluid is in the range of from about 1:1 to about 1:3.

10. The process of claim 1 wherein the water-containing fluid is substantially water.

11. The process of claim 1 wherein the water-containing fluid is water.

12. The process of claim 1 wherein the oil shale solids have a maximum particle size of one-half inch diameter.

13. The process of claim 12 wherein the oil shale solids have a maximum particle size of one-quarter inch diameter.

14. The process of claim 13 wherein the oil shale solids have a maximum particle size of 8 mesh.

15. The process of claim 1 wherein the transition metal in the oxide and salt is selected from the group consisting of vanadium, chromium, manganese, titanium, molybdenum, zirconium, niobium, tantalum, rhenium, and tungsten.

16. The process of claim 15 wherein the transition metal in the oxide and salt is selected from the group consisting of chromium, manganese, titanium, and tungsten.

17. The process of claim 1 wherein the metal in the basic metal carbonate and hydroxide is selected from the group consisting of sodium and potassium.

18. The process of claim 1 wherein the catalyst is present in a catalytically effective amount which is equivalent to a concentration level in the water in the water-containing fluid in the range of from about 0.01 to about 3.0 weight percent.

19. The process of claim 18 wherein the catalyst is present in a catalytically effective amount which is equivalent to a concentration level in the water in the water-containing fluid in the range of from about 0.10 to about 0.50 weight percent.

20. The process of claim 1 wherein essentially all the sulfur removed the recovered hydrocarbons is in the form of elemental sulfur.

* * * * *

UNITED STATES PATENT OFFICE

CERTIFICATE OF CORRECTION

PATENT NO. 3,948,755

DATED April 6, 1976

INVENTOR(S) JOHN D. McCOLLUM and LEONARD M. QUICK

It is certified that error appears in the above-identified patent and that said Letters Patent are hereby corrected as shown below Column 23, line 57, After "and" add -- not --.

Signed and Sealed this

Thirteenth Day of July 1976

[SEAL]

*Attest:*

RUTH C. MASON
*Attesting Officer*

C. MARSHALL DANN
*Commissioner of Patents and Trademarks*